US012167818B2

(12) United States Patent
Yao et al.

(10) Patent No.: US 12,167,818 B2
(45) Date of Patent: Dec. 17, 2024

(54) TOILET COVER PLATE AND TOILET

(71) Applicant: Kohler (China) Investment Co., Ltd., Shanghai (CN)

(72) Inventors: Pingsheng Yao, Shanghai (CN); Taiwoon Woon, Singapore (SG)

(73) Assignee: Kohler (China) Investment Co., Ltd., Shanghai (CN)

( * ) Notice: Subject to any disclaimer, the term of this patent is extended or adjusted under 35 U.S.C. 154(b) by 51 days.

(21) Appl. No.: 17/994,917

(22) Filed: Nov. 28, 2022

(65) Prior Publication Data

US 2023/0172405 A1 Jun. 8, 2023

(30) Foreign Application Priority Data

Dec. 7, 2021 (CN) ..... 202123060864.7

(51) Int. Cl.
*A47K 13/02* (2006.01)

(52) U.S. Cl.
CPC ..... *A47K 13/02* (2013.01)

(58) Field of Classification Search
CPC ..... A47K 13/02
USPC ..... 4/234
See application file for complete search history.

(56) References Cited

U.S. PATENT DOCUMENTS

2005/0138721 A1* 6/2005 Bowman ..... A47K 13/24 4/234
2006/0206998 A1* 9/2006 Corbin ..... A47K 13/24 4/234
2014/0215699 A1* 8/2014 Dillard ..... A47K 17/02 4/234
2017/0290474 A1 10/2017 Kim
2020/0245828 A1 8/2020 Bahn

FOREIGN PATENT DOCUMENTS

GB 569976 A 6/1945
WO 2022226094 A1 10/2022

OTHER PUBLICATIONS

Extended European Search Report from European Patent Application No. 22211715.2, dated Apr. 24, 2023, 10 pages.

* cited by examiner

*Primary Examiner* — Huyen D Le
(74) *Attorney, Agent, or Firm* — Lempia Summerfield Katz LLC

(57) ABSTRACT

A toilet cover plate includes a seat ring including a seat ring hole disposed at a middle portion of the seat ring and includes a seat ring sealing element disposed at a bottom portion of the seat ring. The seat ring sealing element includes a first sealing strip configured to seal a toilet body of a toilet. The toilet cover plate also includes a seat cover, including a seat cover sealing ring disposed at a bottom portion of the seat cover and configured to seal the seat ring. When the seat ring is closed to cover the toilet body, the first sealing strip is contacted with the toilet body. When the seat cover is closed to cover the seat ring, the seat cover sealing ring is contacted with the seat ring.

17 Claims, 8 Drawing Sheets

TOILET COVER PLATE AND TOILET

CROSS REFERENCE TO RELATED APPLICATION

This application claims the benefit of priority to Chinese Patent Application No. 202123060864.7 filed in the Chinese Intellectual Property Office on Dec. 7, 2021, which is hereby incorporated by reference in its entirety.

FIELD

The present disclosure relates to the technical field of toilets, in particular to a toilet cover plate and a toilet.

BACKGROUND

A toilet comprises a ceramic body and a toilet cover plate, and the toilet cover plate comprises a seat ring and a seat cover. The seat ring and the seat cover are mounted on the ceramic body through a pivotal shaft.

The toilet cover plate lacks a sealing function, and when the toilet cover plate covers a ceramic body, there are large gaps both between a seat ring and the ceramic body and between a seat cover and the seat ring. Thus, the outward volatilization of aerosol generated in a cavity of the ceramic body cannot be inhibited or reduced.

In view of the above technical problem, it is necessary to provide a toilet cover plate and a toilet with a sealing function to effectively reduce the overflow of aerosol.

SUMMARY

The present disclosure aims to overcome the foregoing shortcomings by providing a toilet cover plate and a toilet with a sealing function. Thus, the overflow of aerosol may be effectively reduced.

The present disclosure provides a toilet cover plate, comprising a seat ring and a seat cover. A seat ring hole is formed in a middle portion of the seat ring.

A bottom portion of the seat ring is provided with a seat ring sealing element, and the seat ring sealing element comprises a first sealing strip configured to form a seal with a ceramic body of a toilet.

A bottom portion of the seat cover is provided with a seat cover sealing ring configured to form a seal with the seat ring.

When the seat ring covers the ceramic body, the first sealing strip is contacted with the ceramic body.

When the seat cover covers the seat ring, the seat cover sealing ring is contacted with the seat ring.

In an embodiment, the seat cover sealing ring is correspondingly matched with the seat ring hole.

When the seat cover covers the seat ring, the seat cover sealing ring is located in the seat ring hole and contacted with a hole wall of the seat ring hole.

In an embodiment, the seat ring sealing element further comprises a second sealing strip. The second sealing strip is arranged around a lower edge of the seat ring hole, and the first sealing strip is located on an outer side of the second sealing strip.

The seat cover sealing ring is correspondingly matched with the seat ring hole.

When the seat cover covers the seat ring, the seat cover sealing ring is located in the seat ring hole, the seat cover sealing ring is in clearance fit with a hole wall of the seat ring hole, and the seat cover sealing ring is contacted with the second sealing strip.

In an embodiment, the contour of the seat ring hole is closed, the first sealing strip is a first sealing ring, and the second sealing strip is a second sealing ring.

In an embodiment, a front end of the seat ring is provided with a seat ring gap communicated with the seat ring hole, and a front end of the seat cover sealing ring is provided with a seat cover sealing body used for sealing the seat ring gap.

When the seat cover covers the seat ring, the seat cover sealing body is located in the seat ring gap and contacted with a side wall of the seat ring gap.

In an embodiment, the seat ring sealing element further comprises third sealing strips, and the third sealing strips are located on two sides of a lower opening of the seat ring gap.

When the seat cover covers the seat ring, the seat cover sealing body is located in the seat ring gap, the seat cover sealing body is in clearance fit with the side wall of the seat ring gap, and the seat cover sealing body is contacted with the third sealing strip.

In an embodiment, the bottom portion of the seat cover is provided with a support rib in a circle, and the seat cover sealing ring is connected with the support rib.

In an embodiment, the seat cover sealing ring surrounds an outer surface of the support rib.

In an embodiment, at least one buffer air cavity is formed between the seat cover sealing ring and the support rib, and a channel configured to allow air to flow into and from the buffer air cavity is further formed between the seat cover sealing ring and the support rib.

When the seat cover covers the seat ring, the channel is communicated with the seat ring hole.

In an embodiment, the buffer air cavity is located at a rear portion of the seat cover.

In an embodiment, a bottom portion of the first sealing strip is connected with an elastic membrane, and the elastic membrane extends towards the seat ring hole.

When the seat ring covers the ceramic body, the elastic membrane is located on the ceramic body.

When an inside air pressure of the elastic membrane is greater than or equal to an outside air pressure of the elastic membrane, the elastic membrane keeps in contact with the ceramic body.

When the outside air pressure of the elastic membrane is greater than the inside air pressure of the elastic membrane, the elastic membrane is at least partially separated from the ceramic body.

In an embodiment, the elastic membrane is an arc-shaped membrane.

In an embodiment, the elastic membrane is arranged at a rear portion of the first sealing strip.

In one optional technical solution, a front end of the seat cover is provided with a hand clasping groove.

The present disclosure further provides a toilet comprising a ceramic body and the toilet cover plate as discussed above. The seat ring and the seat cover are respectively mounted on the ceramic body through a pivotal shaft.

When the toilet cover plate covers the ceramic body, the first sealing strip is contacted with the ceramic body, and the seat cover sealing ring is contacted with the seat ring.

The foregoing toilet cover plate and the toilet can achieve the following beneficial effects:

The toilet cover plate and the toilet provided by the present disclosure may realize a sealing function by configuring the seat ring sealing element and the seat cover sealing ring and thus can effectively inhibit or prevent the aerosol from overflowing from the ceramic body cavity.

The toilet cover plate and the toilet provided by the present disclosure can store the gas overflowing from the buffer air cavity when the water is stored in the ceramic body by configuring the buffer air cavity. The buffer air cavity can play a role in buffering the air pressure and can effectively prevent the toilet cover plate from jumping due to the increase of the air pressure in the cavity.

According to the toilet cover plate and the toilet provided by the present disclosure, the elastic membrane is arranged at the bottom portion of the first sealing strip. At the moment of washing the ceramic body, the water enters the ceramic body cavity. Thus, the inside pressure of the elastic membrane is greater than the outside pressure of the elastic membrane, under the action of the inside pressure, and the elastic membrane may expand and keep sealing the ceramic body. After a siphon occurs in the ceramic body, the pressure in the ceramic body cavity becomes a negative pressure instantly, the elastic membrane no longer seals the ceramic body, and the external air is replenished into the ceramic body cavity in time to maintain the balance between the inside air pressure and outside air pressure and reduce the influence on the siphoning function.

BRIEF DESCRIPTION OF THE FIGURES

Referring to the drawings, those having ordinary skill in the art should more easily understand the disclosure of the present disclosure. It should be understood that the drawings are for the purpose of illustration only and are not intended to limit the protection scope of the present disclosure. In the drawings.

DETAILED DESCRIPTION

Figure 1:
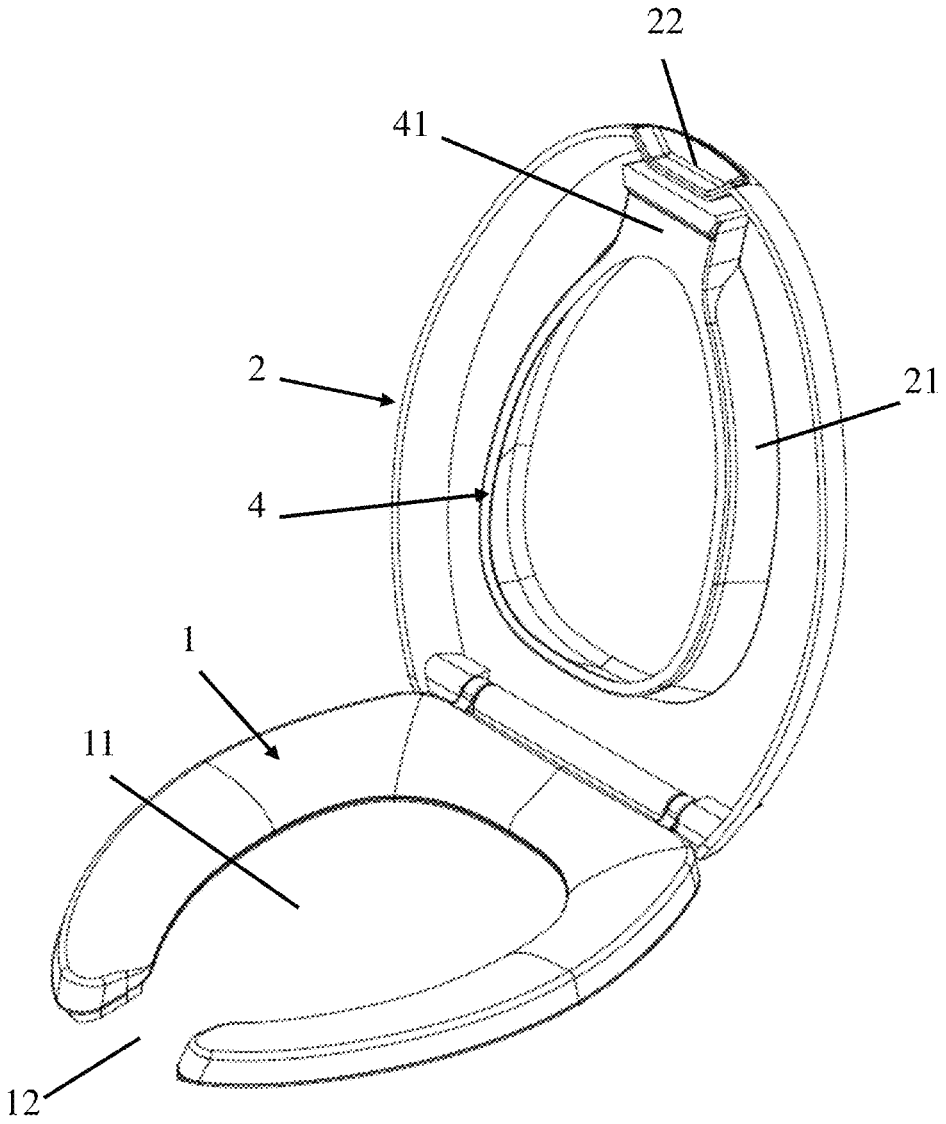
FIG. 1 is a three-dimensional diagram of a toilet cover plate according to an example of the present disclosure.

The specific embodiments of the present disclosure are further described with reference to the drawings hereinafter. Same or equivalent parts are denoted by same reference numerals. It should be noted that the terms "front", "back", "left", "right", "up", and "down" used in the following description refer to the directions in the drawings, and the terms "inner" and "outer" refer to the directions towards or far away from geometric centers of specific parts respectively.

Figure 2:
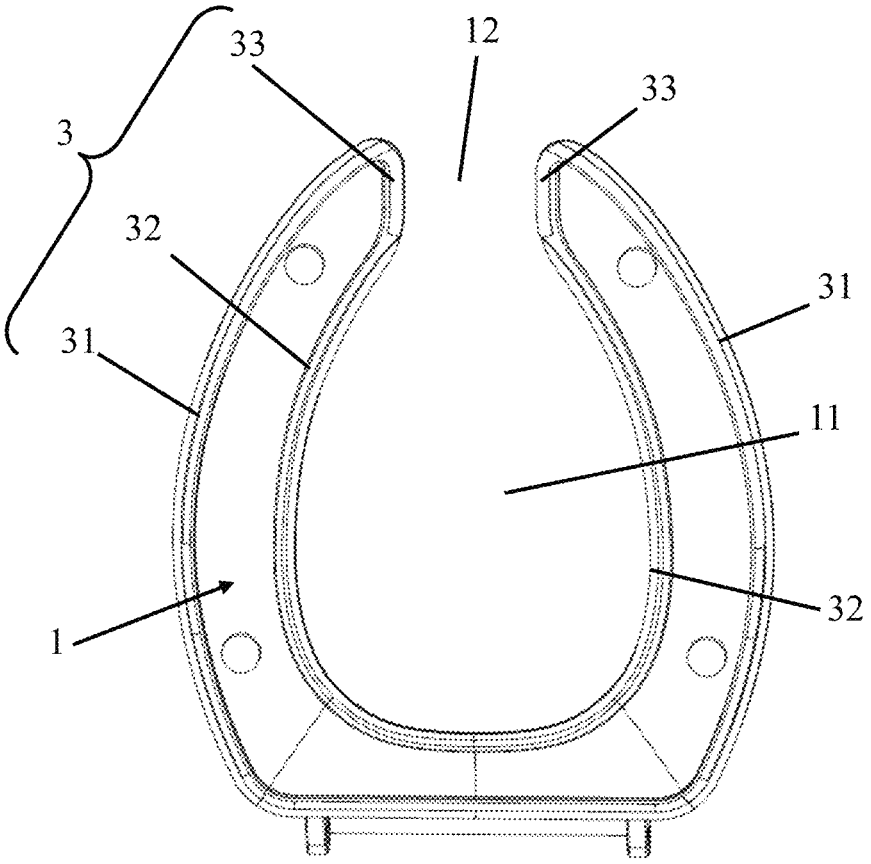
FIG. 2 is a bottom view of a seat ring.
Figure 3:
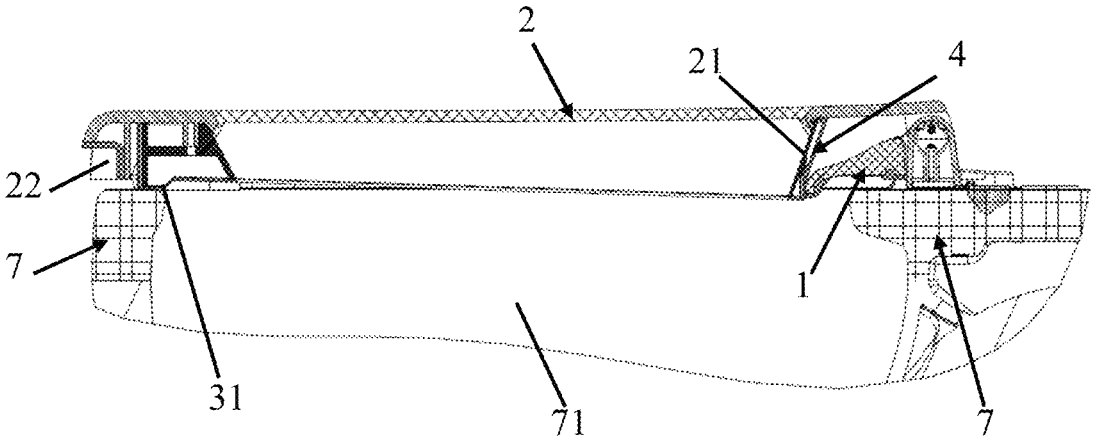
FIG. 3 is a partial sectional view of the toilet cover when being covers a ceramic body.

FIG. 1 is a three-dimensional diagram of a toilet cover plate according to an example of the present disclosure. FIG. 2 is a bottom view of a seat ring. FIG. 3 is a partial sectional view of the toilet cover when being covers a ceramic body. As shown in FIGS. 1-3, an embodiment of the present disclosure provides a toilet cover plate, comprising a seat ring 1 and a seat cover 2. A seat ring hole 11 is formed in a middle portion of the seat ring 1.

A bottom portion of the seat ring 1 is provided with a seat ring sealing element 3, and the seat ring sealing element 3 comprises a first sealing strip 31 configured to seal a ceramic body 7 of a toilet.

A bottom portion of the seat cover 2 is provided with a seat cover sealing ring 4 configured to seal the seat ring 1.

When the seat ring 1 covers (e.g., in a closed state) the ceramic body 7, the first sealing strip 31 is contacted with the ceramic body 7.

When the seat cover 2 covers (e.g., in a closed state) the seat ring 1, the seat cover sealing ring 4 is contacted with the seat ring 1.

The toilet cover plate provided by the present disclosure is configured to be mounted on the ceramic body 7 of the toilet and comprises the seat ring 1 and the seat cover 2. The seat ring 1 and the seat cover 2 are mounted on the ceramic body 7 through a pivotal shaft 8. The seat cover 2 is located above the seat ring 1.

The seat ring hole 11 is formed in the middle portion of the seat ring 1. The bottom portion of the seat ring 1 is provided with the seat ring sealing element 3, and the seat ring sealing element 3 is a rubber sealing element. The seat ring sealing element 3 comprises the first sealing strip 31, and the first sealing strip 31 is located on an outer side of the seat ring hole 11. When the seat ring 1 covers the ceramic body 7, the first sealing strip 31 is contacted with and thus seals a top surface of the ceramic body 7 to effectively prevent aerosol in a cavity 71 of the ceramic body 7 from overflowing between the seat ring 1 and the ceramic body 7.

A shape of the first sealing strip 31 may be selected according to a shape of the seat ring hole 11. If the seat ring 1 is a complete seat ring, the first sealing strip 31 has a shape of a sealing ring. If the seat ring 1 is a seat ring with a gap, the first sealing strip 31 has a shape of a major arc.

The bottom portion of the seat cover 2 is provided with the seat cover sealing ring 4. The seat cover sealing ring 4 is a rubber sealing ring. When the seat cover 2 covers the seat ring 1, the seat cover sealing ring 4 is in sealing contact with the seat ring 1 to effectively prevent the aerosol in the cavity 71 of the ceramic body 7 from overflowing between the seat ring 1 and the seat cover 2.

The seat cover sealing ring 4 may be in sealing contact with the top surface of the seat ring 1 and may also be in sealing contact with the hole wall of the seat ring hole 11.

In conclusion, the toilet cover plate provided by the present disclosure may realize a sealing function by configuring the first sealing strip 31 and the seat cover sealing ring 4 and can effectively reduce the aerosol from overflowing from the cavity 71 of the ceramic body 7.

In one embodiment, as shown in FIGS. 1-3, the seat cover seal 4 is correspondingly matched with the seat ring hole 11. When the seat cover 2 covers the seat ring 1, the seat cover sealing ring 4 is located in the seat ring hole 11 and is contacted with the hole wall of the seat ring hole 11.

In this embodiment, the seat cover sealing ring 4 is located within a boundary scope of the seat ring hole 11. When the seat cover 2 covers the seat ring 1, the seat cover sealing ring 4 is inserted into the seat ring hole 11, and the seat cover sealing ring 4 is in sealing contact with the hole wall of the seat ring hole 11, so that the aerosol can be prevented from overflowing outwards from the seat ring hole 11.

In one embodiment, as shown in FIGS. 1-4, the seat ring sealing element 3 further comprises a second sealing strip 32, the second sealing strip 32 is arranged around or surrounds a lower edge of the seat ring hole 11, and the first sealing strip 31 is located on an outer side of the second sealing strip 32.

The seat cover sealing ring 4 is correspondingly matched with the seat ring hole 11.

When the seat cover 2 covers the seat ring 1, the seat cover sealing ring 4 is located in the seat ring hole 11, the seat cover sealing ring 4 is in clearance fit with the hole wall of the seat ring hole 11, and the seat cover sealing ring 4 is contacted with the second sealing strip 32.

In this embodiment, the seat ring sealing element 3 comprises the first sealing strip 31 and the second sealing strip 32. The second sealing strip 32 is located around or surrounds the lower edge of the seat ring hole 11 and the first sealing strip 31 is located at the outer side of the second sealing strip 32.

When the seat cover 2 covers the seat ring 1, the seat cover sealing ring 4 is inserted into the seat ring hole 11, the seat cover sealing ring 4 is in clearance fit with the hole wall of the seat ring hole 11, and the seat cover sealing ring 4 is contacted with and thus seals the second sealing strip 32. Such a configuration can avoid a friction between the seat cover sealing ring 4 and the hole wall of the seat ring hole 11. In addition, a lower opening of the seat ring hole 11 is sealed through the seat cover sealing ring 4 and the second sealing strip 32, so that the aerosol can be prevented from overflowing outwards from the seat ring hole 11.

A shape of the second sealing strip 32 may be selected according to the shape of the seat ring hole 11. If the seat ring 1 is a complete seat ring, the second sealing strip 32 has a shape of a sealing ring. If the seat ring 1 is a seat ring with a gap, the second sealing strip 32 has a shape of a major arc.

In one embodiment, the seat ring hole 11 has a closed contour line, the first sealing strip 31 is a first sealing ring (e.g., a first closed ring), and the second sealing strip 32 is a second sealing ring (e.g., a second closed ring). In other words, when the seat ring 1 is a complete seat ring without a gap, the first sealing strip 31 and the second sealing strip 32 are both annular sealing strips.

In one embodiment, as shown in FIGS. 1-3, a front end of the seat ring 1 includes a seat ring gap 12 communicated with the seat ring hole 11, and a front end of the seat cover sealing ring 4 includes a seat cover sealing body 41 configured to seal the seat ring gap 12.

When the seat cover 2 covers the seat ring 1, the seat cover sealing body 41 is disposed in the seat ring gap 12 and contacted with a side wall of the seat ring gap 12.

In this embodiment, the seat ring 1 includes a gap. The seat ring gap 12 is disposed at the front end of the seat ring 1, and the seat ring gap 12 is communicated with the seat ring hole 11. The front end of the seat cover sealing ring 4 includes the seat cover sealing body 41, and the seat cover sealing body 41 is configured to seal the seat ring gap 12.

When the seat cover 2 covers the seat ring 1, the seat cover sealing body 41 is disposed in the seat ring gap 12, and the seat cover sealing body 41 is in sealing contact with a side wall of the seat ring gap 12, so that the aerosol can be prevented from overflowing from the seat ring gap 12.

In one embodiment, the seat cover sealing body 41 is integrally formed at the front end of the seat cover sealing ring 4.

In one embodiment, as shown in FIGS. 1 and 2, the seat ring sealing element 3 further comprises third sealing strips 33, and the third sealing strips 33 are disposed on two sides of a lower opening of the seat ring gap 12.

When the seat cover 2 covers the seat ring 1, the seat cover sealing body 41 is disposed in the seat ring gap 12, the seat cover sealing body 41 is in clearance fit with the side wall of the seat ring gap 12, and the seat cover sealing body 41 is contacted with the third sealing strip 33.

In this embodiment, the seat ring sealing element 3 further comprises the two third sealing strips 33. The two third sealing strips 33 are disposed on two sides of the lower opening of the seat ring gap 12.

When the seat cover 2 covers the seat ring 1, the seat cover sealing body 41 is inserted into the seat ring gap 12, the seat cover sealing body 41 is in clearance fit with the side wall of the seat ring gap 12, the seat cover sealing body 41 is in sealing contact with the third sealing strip 33. Such a configuration can avoid a friction between the seat cover sealing body 41 and the side wall of the seat ring gap 12 and prevent the aerosol from overflowing from the seat ring gap 12 by sealing the lower opening of the seat ring gap 12 through the seat cover sealing body 41 and the third sealing strip 33.

In one embodiment, the third sealing strip 33 is connected between the first sealing strip 31 and the second sealing strip 32. The first sealing strip 31, the second sealing strip 32, and the third sealing strip 33 form a closed sealing structure.

In one embodiment, the first sealing strip 31, the second sealing strip 32, and the third sealing strip 33 are integrally formed.

In one embodiment, as shown in FIG. 1, the bottom portion of the seat cover 2 is provided with a support rib 21 in a circle, and the seat cover sealing ring 4 is connected with the support rib 21. The support rib 21 is a plastic piece, and the support rib 21 provides support for the seat cover sealing ring 4.

In one embodiment, as shown in FIG. 1, the seat cover sealing ring 4 surrounds an outer surface of the support rib 21 to improve mounting stability of the seat cover sealing ring 4.

Figure 4:
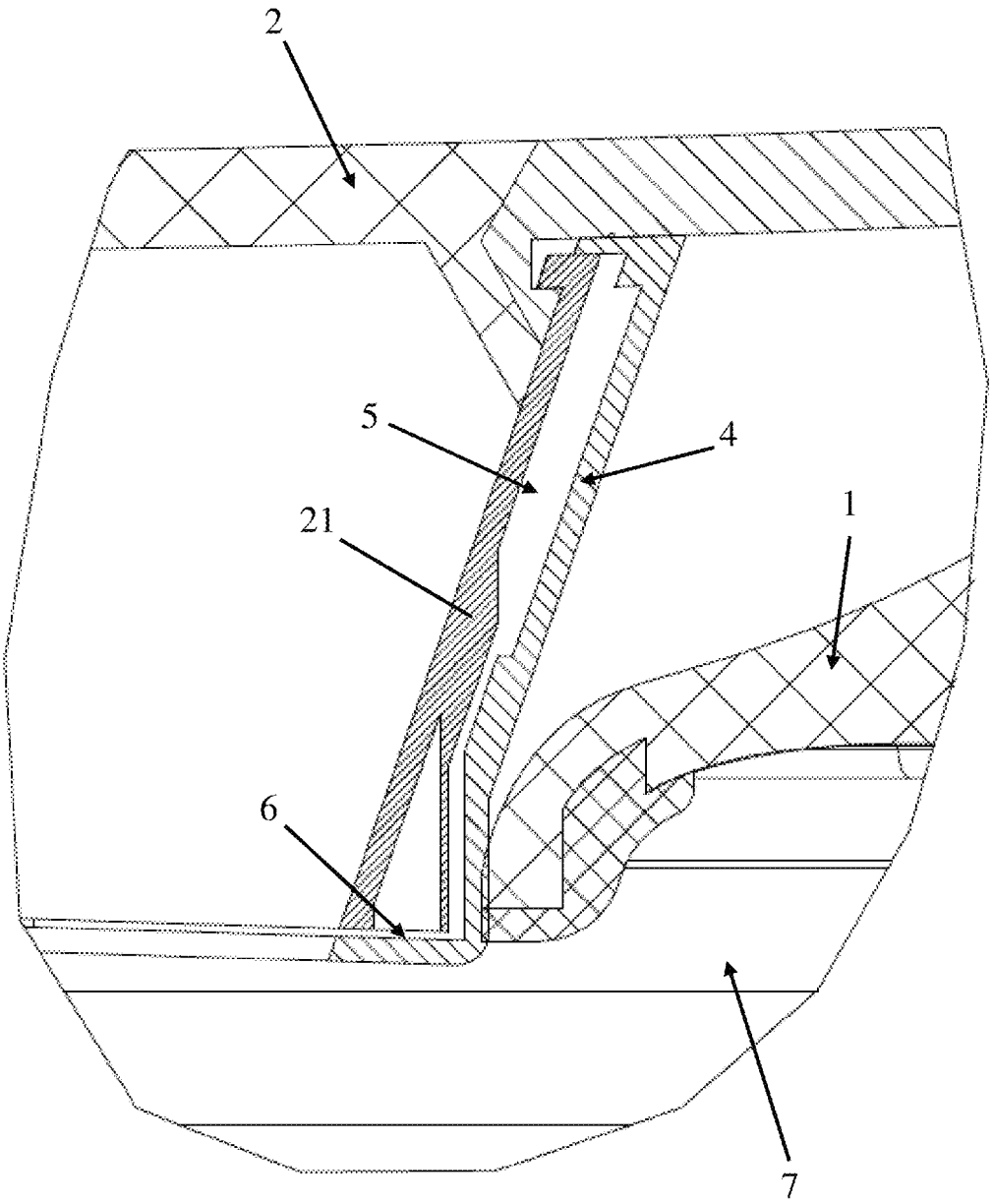
FIG. 4 is a schematic diagram of a buffer air cavity formed between a seat cover sealing ring and a support rib.

FIG. 4 is a schematic diagram of a buffer air cavity formed between a seat cover sealing ring and a support rib. In one embodiment, as shown in FIG. 4, at least one buffer air cavity 5 is formed between the seat cover sealing ring 4 and the support rib 21, and a channel 6 configured to allow air to flow into or from the buffer air cavity 5 is further formed between the seat cover sealing ring 4 and the support rib 21. When the seat cover 2 covers the seat ring 1, the channel 6 is communicated with the seat ring hole 11.

In this embodiment, the buffer air cavity 5 may be used as a decompression air bag. The buffer air cavity 5 is formed between the seat cover sealing ring 4 and the support rib 21. The air in the buffer air cavity 5 is charged and discharged through the channel 6. A vent of the channel 6 is located on the support rib 21.

When the seat cover 2 covers the seat ring 1, the channel 6 is communicated with the seat ring hole 11. Therefore, after the water is drained from the cavity 71 of the ceramic body 7 and when the cavity starts to store water, an air pressure in the cavity 71 is increased along with the rising water level, the air may enter the buffer air cavity 5 through the seat ring hole 11 and the channel 6, and the part of the seat cover sealing ring 4 corresponding to the buffer air cavity 5 can expand to buffer the air pressure. Thus, the toilet cover plate is effectively prevented from jumping due to the increase of the air pressure in the cavity 71.

In one embodiment, as shown in FIGS. 3 and 4, the buffer air cavity 5 is located at a rear portion of the seat cover 2. The space between the rear portion of the seat cover 2 and the seat ring 1 is large, so that it is advantageous to arrange the buffer air cavity 5 and allow the expansion and contraction of the seat cover sealing ring 4.

Figure 5:
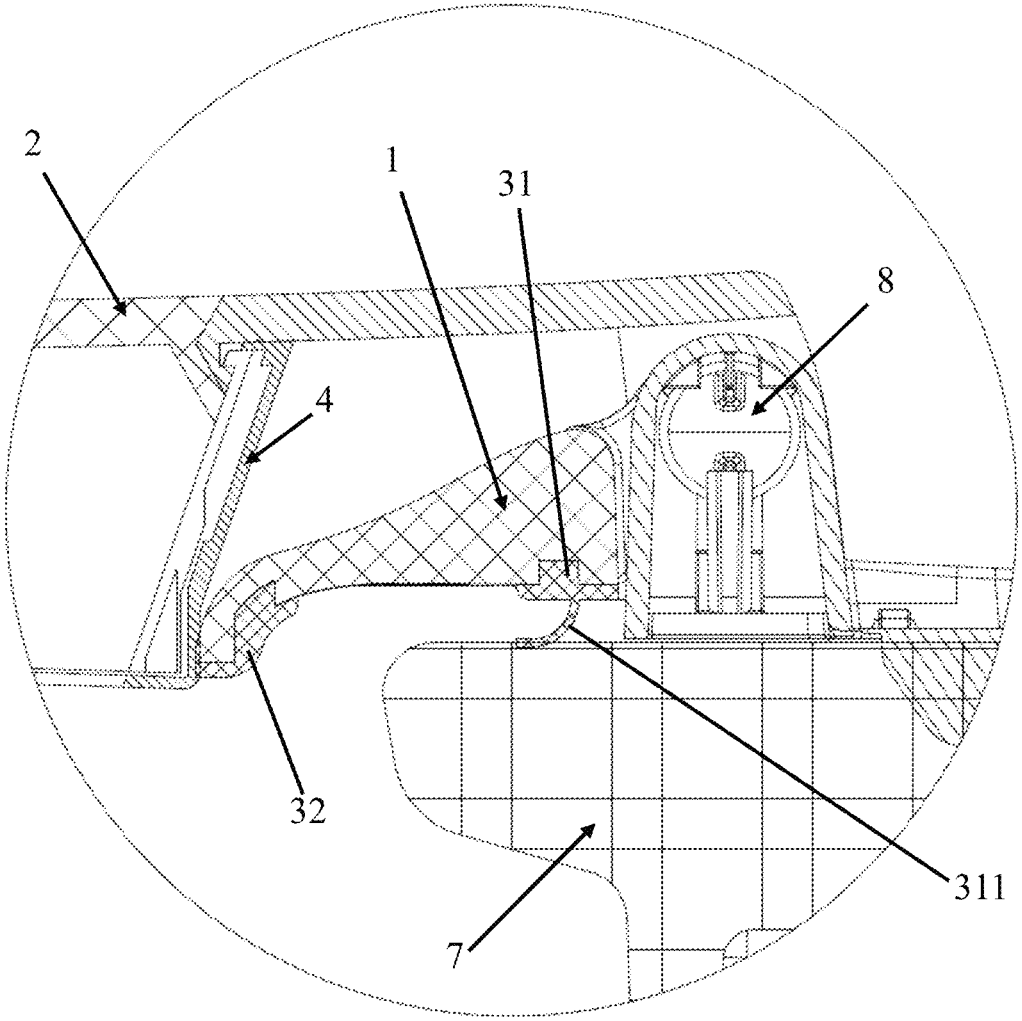
FIG. 5 is a schematic diagram of a bottom portion of a first sealing strip connected with an elastic membrane.

FIG. 5 is a schematic diagram of a bottom portion of a first sealing strip connected with an elastic membrane. In one embodiment, as shown in FIG. 5, a bottom portion of the first sealing strip 31 is connected with an elastic membrane 311, and the elastic membrane 311 extends towards the seat ring hole 11.

When the seat ring 1 covers the ceramic body 7, the elastic membrane 311 is located on the ceramic body 7.

When an inside air pressure of the elastic membrane 311 is greater than or equal to an outside air pressure of the elastic membrane, the elastic membrane 311 keeps in contact with the ceramic body 7.

When the outside air pressure of the elastic membrane 311 is greater than the inside air pressure of the elastic membrane, the elastic membrane 311 is at least partially separated from the ceramic body 7.

In this embodiment, the elastic membrane 311 is used as a check valve. The elastic membrane 311 is a rubber elastic sheet. The elastic membrane 311 is integrally arranged at the bottom portion of the first sealing strip 31. If necessary, the elastic membrane 311 may be arranged in a partial region of the first sealing strip 31. An upper end of the elastic membrane 311 is connected with the first sealing strip 31, and a lower end of the elastic membrane 311 extends toward the seat ring hole 11.

When the seat ring 1 covers the ceramic body 7, the lower end of the elastic membrane 311 is attached on the ceramic body 7.

At the moment of washing or flushing the ceramic body 7, the water enters the cavity 71 of the ceramic body 7, and the water level in the cavity 71 rises. Thus, the inside air pressure of the elastic membrane 311 is greater than the outside air pressure of the elastic membrane. Under the action of the inside air pressure, the elastic membrane 311 may expand outwards, and the lower end of the elastic membrane 311 can be more tightly attached to the top surface of the ceramic body 7. Thus, the elastic membrane 311 seals the ceramic body 7 to prevent the aerosol from overflowing.

After the siphon occurs in the ceramic body 7, the water in the cavity 71 of the ceramic body 7 is drained, and the air pressure in the cavity 71 becomes small or is decreased. Thus, the inside air pressure of the elastic membrane 311 is smaller than the outside air pressure of the elastic membrane. Under the action of the outside air pressure, the lower end of the elastic membrane 311 leaves the top surface of the ceramic body 7, and the elastic membrane 311 does not seal the ceramic body 7. Thus, the external air is timely supplied into the cavity 71 of the ceramic body 7 to maintain the balance between the inside air pressure and the outside air pressure and reduce the influence on the siphoning function.

In one embodiment, as shown in FIG. 5, the flexible membrane 311 is an arc-shaped membrane. When the seat ring 1 covers the ceramic body 7, a lower end and an arc-shaped portion of the arc-shaped membrane are attached to the ceramic body 7, so that the ceramic body 7 can be better sealed.

In one embodiment, as shown in FIG. 3 and FIG. 5, the elastic membrane 311 is arranged at a rear portion of the first sealing strip 31. The space in a rear end area of the seat ring 1 is large and thus facilitates the arrangement of the elastic membrane 311.

In one embodiment, as shown in FIG. 1 and FIG. 3, a front end of the seat cover 2 is provided with a hand clasping groove 22 to facilitate a user to lift the seat cover 2.

Figure 6:
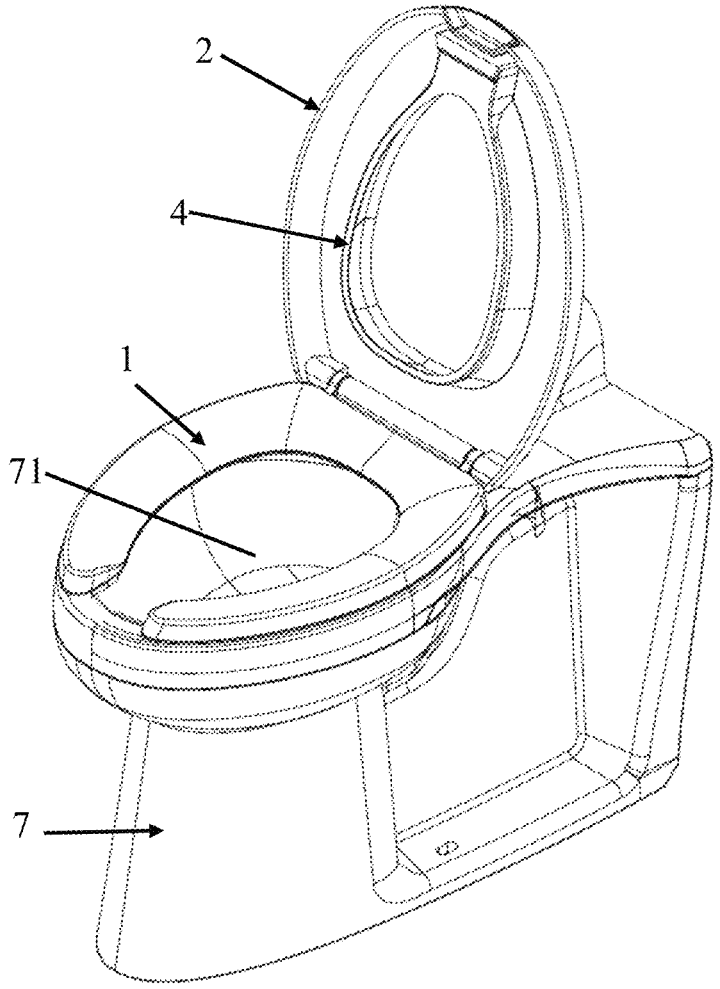
FIG. 6 is a three-dimensional diagram of a toilet according to an example of the present disclosure.

FIG. 6 is a three-dimensional diagram of a toilet according to an example of the present disclosure. As shown in FIG. 6, a toilet provided by an embodiment of the present disclosure comprises a ceramic body 7 and the toilet cover plate according to any of the foregoing embodiments, and the seat ring 1 and the seat cover 2 are respectively mounted on the ceramic body 7 through a pivot shaft 8.

When the toilet cover plate covers the ceramic body 7, the first sealing strip 31 is contacted with the ceramic body 7, and the seat cover sealing ring 4 is contacted with the seat ring 1.

The toilet provided by the present disclosure comprises the ceramic body 7 and the toilet cover plate.

For the structure, construction, and working principle of the toilet cover plate are described above.

Figure 7:
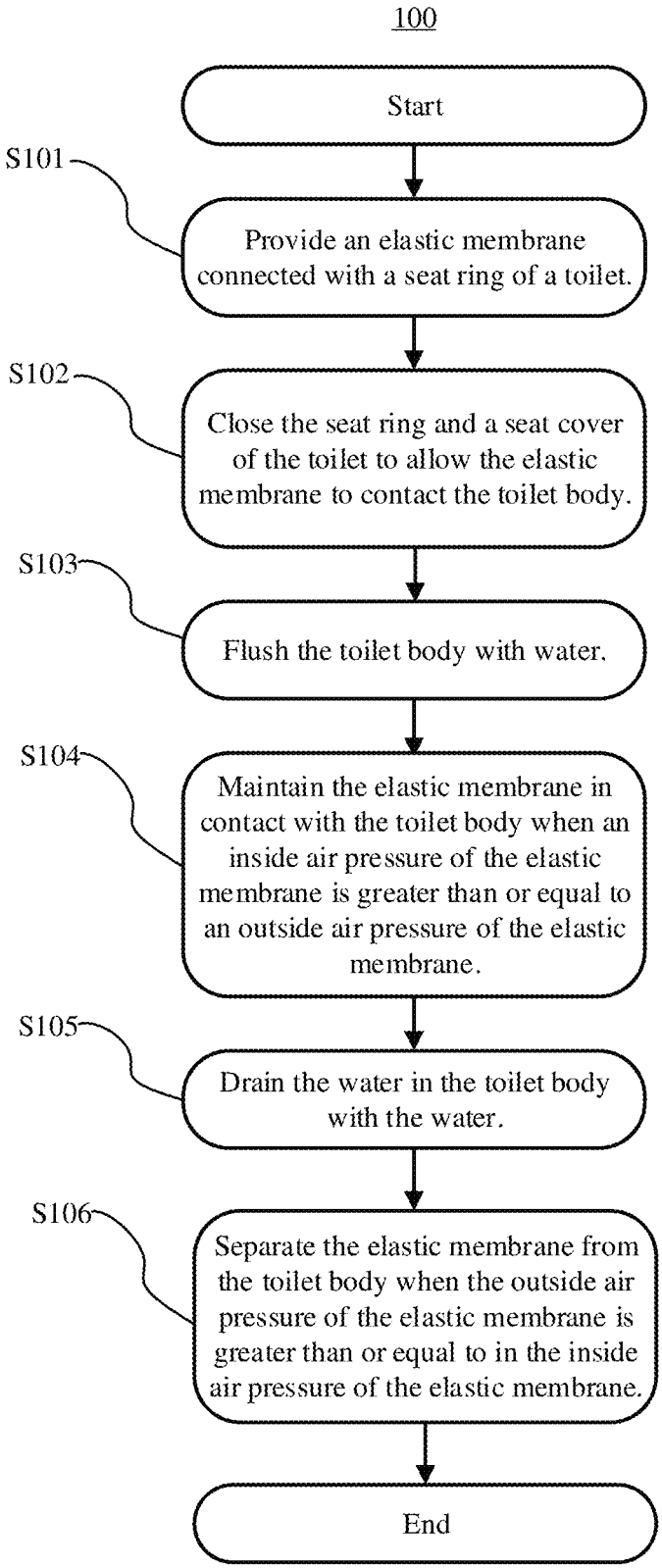
FIG. 7 is a flow chart of a method for cleaning a toilet body according to a first example of the present disclosure.

FIG. 7 is a flow chart of a method 100 for cleaning the toilet body according to a first example of the present disclosure. The method 100 for cleaning the toilet may be performed by the toilet cover plate according to any of the foregoing embodiments. The toilet cover plate is configured to perform an operation, function, or the like as described in the present disclosure. The toilet body cleaned by the method may be the ceramic body 7 according to any of the foregoing embodiments.

At act S101, a user may connect the elastic membrane 311 connected with the seat ring 1 of the toilet. As noted above, the bottom portion of the first sealing strip 31 may be connected with seat ring 1 via the elastic membrane 311, and the elastic membrane 311 may extend towards the seat ring hole 11.

At act S102, the user may close the seat ring 1 and the seat cover 2 to cover the toilet body and allow the elastic membrane 311 to contact the toilet body.

At act S103, the user may flush the toilet body with water to perform the cleaning.

At act S104, the flushing increases an inside air pressure of the elastic membrane 311 and when the inside air pressure of the elastic membrane 311 is greater than or equal to an outside air pressure of the elastic membrane 311, the elastic membrane 311 is maintained in contact with the toilet body.

Specifically, as noted above, the water enters the cavity 71 of the ceramic body 7, and the water level in the cavity 71 rises. Thus, the inside air pressure of the elastic membrane 311 is greater than the outside air pressure of the elastic membrane. Under the action of the inside air pressure, the elastic membrane 311 may expand outwards, and the lower end of the elastic membrane 311 can be more tightly attached to the top surface of the ceramic body 7. Thus, the elastic membrane 311 seals the ceramic body 7 to prevent the aerosol from overflowing.

At act S105, the toilet drains the water in the toilet body with the water.

At act S106, the draining decreases the inside air pressure of the elastic membrane and when the outside air pressure of the elastic membrane 311 is greater than the inside air pressure of the elastic membrane 311, the elastic membrane 311 is at least partially separated from the toilet body.

Specifically, as noted above, after the siphon occurs in the ceramic body 7, the water in the cavity 71 of the ceramic body 7 is drained, and the air pressure in the cavity 71 becomes small or is decreased. Thus, the inside air pressure of the elastic membrane 311 is smaller than the outside air pressure of the elastic membrane. Under the action of the outside air pressure, the lower end of the elastic membrane 311 leaves the top surface of the ceramic body 7, and the elastic membrane 311 does not seal the ceramic body 7. Thus, the external air is timely supplied into the cavity 71 of the ceramic body 7 to maintain the balance between the inside air pressure and the outside air pressure and reduce the influence on the siphoning function.

Figure 8:
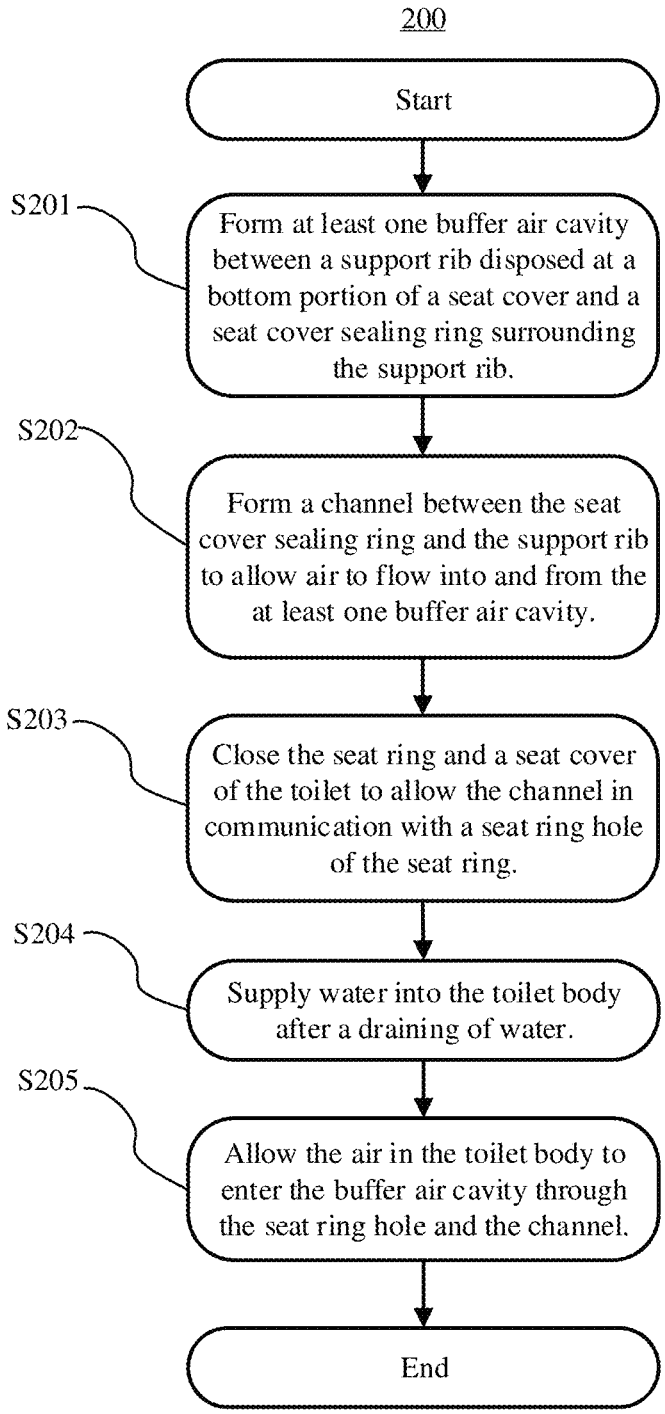
FIG. 8 is a flow chart of a method for cleaning the toilet body according to a second example of the present disclosure.

FIG. 8 is a flow chart of a method 100 for cleaning the toilet body according to a second example of the present disclosure. The method 200 for cleaning the toilet may be performed by the toilet cover plate according to any of the foregoing embodiments. The toilet cover plate is configured to perform an operation, function, or the like as described in the present disclosure. The toilet body cleaned by the method may be the ceramic body 7 according to any of the foregoing embodiments.

At act S201, a user may form at least one buffer air cavity 5 between the support rib 21 disposed at the bottom portion of the seat cover 2 and the seat cover sealing ring 4 surrounding the support rib 21.

At act S202, the user may form the channel 6 between the seat cover sealing ring 4 and the support rib 21 to allow the air to flow into and from the at least one buffer air cavity 5.

At act S203, the user may close the seat ring 1 and the seat cover 2 of the toilet to allow the channel in communication with the seat ring hole 11 of the seat ring 1.

At act S204, the toilet may supply water into the toilet body after a draining of the water. The draining of the water may be performed at act S105.

At act S205, the toilet allows the air in the toilet body to enter the buffer air cavity 5 through the seat ring hole 11 and the channel 6.

Specifically, as noted above, after the water is drained from the cavity 71 of the ceramic body 7 and when the cavity starts to store water, an air pressure in the cavity 71 is increased along with the rising water level, the air may enter the buffer air cavity 5 through the seat ring hole 11 and the channel 6, and the part of the seat cover sealing ring 4 corresponding to the buffer air cavity 5 can expand to buffer the air pressure. Thus, the toilet cover plate is effectively prevented from jumping due to the increase of the air pressure in the cavity 71.

Some acts of the method 200 may be performed before or at the same time some acts of the method 100 is performed. For example, acts S201, S202, and S203 may be performed before or at the same time the act S105 the method 100 is performed.

Some acts of the method 200 may be performed after the method 100 is performed. For example, S204 and S205 may be performed before or at the same time the act S105 the method 100 is performed.

According to the needs, the above embodiments may be combined to achieve the different technical effects.

The above only describes the principles and the embodiments of the present disclosure. Those of ordinary skill in the art should understand that other modifications can be made based on the principle of the present disclosure and should also be within the scope of protection of the present disclosure.

We claim:

1. A toilet cover plate, comprising:

a seat ring, comprising:

a seat ring hole disposed at a middle portion of the seat ring; and a seat ring sealing element disposed at a bottom portion of the seat ring and comprising a first sealing strip configured to seal a toilet body of a toilet; and a seat cover, comprising a seat cover sealing ring disposed at a bottom portion of the seat cover and configured to seal the seat ring, wherein the seat cover sealing ring is correspondingly matched with the seat ring hole, wherein when the seat ring is closed to cover the toilet body, the first sealing strip is contacted with the toilet body, and wherein when the seat cover is closed to cover the seat ring, the seat cover sealing ring is contacted with the seat ring, disposed in the seat ring hole, and contacted with a hole wall of the seat ring hole.

2. The toilet cover plate according to claim 1, wherein the seat ring sealing element further comprises a second sealing strip surrounding a lower edge of the seat ring hole, wherein the first sealing strip is disposed on an outer side of the second sealing strip, wherein the seat cover sealing ring is correspondingly matched with the seat ring hole, wherein when the seat cover is closed to cover the seat ring, the seat cover sealing ring is disposed in the seat ring hole, the seat cover sealing ring is in clearance fit with a hole wall of the seat ring hole, and the seat cover sealing ring is contacted with the second sealing strip.

3. The toilet cover plate according to claim 2, wherein a contour of the seat ring hole is closed, the first sealing strip is a first closed ring, and the second sealing strip is a second closed ring.

4. The toilet cover plate according to claim 1, wherein a front end of the seat ring comprises a seat ring gap communicated with the seat ring hole, and a front end of the seat cover sealing ring includes a seat cover sealing body configured to seal the seat ring gap, and wherein when the seat cover is closed to cover the seat ring, the seat cover sealing body is disposed in the seat ring gap and contacted with a side wall of the seat ring gap.

5. The toilet cover plate according to claim 4, wherein the seat ring sealing element further comprises third sealing strips respectively disposed on two sides of a lower opening of the seat ring gap, and wherein when the seat cover is closed to cover the seat ring, the seat cover sealing body is disposed in the seat ring gap, the seat cover sealing body is in clearance fit with the side wall of the seat ring gap, and the seat cover sealing body is contacted with the third sealing strips.

6. The toilet cover plate according to claim 1, wherein a support rib is disposed at the bottom portion of the seat cover, and wherein the seat cover sealing ring is connected with the support rib.

7. The toilet cover plate according to claim 6, wherein the seat cover sealing ring surrounds an outer surface of the support rib.

8. The toilet cover plate according to claim 7, wherein at least one buffer air cavity is formed between the seat cover sealing ring and the support rib, wherein a channel is formed between the seat cover sealing ring and the support rib and configured to allow air to flow into and from the at least one buffer air cavity, and wherein when the seat cover is closed to cover the seat ring, the channel is communicated with the seat ring hole.

9. The toilet cover plate according to claim 8, wherein the buffer air cavity is disposed at a rear portion of the seat cover.

10. The toilet cover plate according to claim 1, wherein a bottom portion of the first sealing strip is connected with an elastic membrane, wherein the elastic membrane extends towards the seat ring hole, wherein when the seat ring is closed to cover the toilet body the elastic membrane contacts the toilet body, wherein when an inside air pressure of the elastic membrane is greater than or equal to an outside air pressure of the elastic membrane, the elastic membrane keeps in contact with the toilet body, and wherein when the outside air pressure of the elastic membrane is greater than the inside air pressure of the elastic membrane, the elastic membrane is at least partially separated from the toilet body.

11. The toilet cover plate according to claim 10, wherein the elastic membrane is an arc-shaped membrane.

12. The toilet cover plate according to claim 10, wherein the elastic membrane is disposed at a rear portion of the first sealing strip.

13. The toilet cover plate according to claim 1, wherein a front end of the seat cover is provided with a hand clasping groove.

14. A toilet, comprising:

a toilet body; and a toilet cover plate, comprising:

a seat ring, comprising:

a seat ring hole disposed at a middle portion of the seat ring; and a seat ring sealing element disposed at a bottom portion of the seat ring and comprising a first sealing strip configured to seal a toilet body of a toilet; and a seat cover, comprising a seat cover sealing ring disposed at a bottom portion of the seat cover and configured to seal the seat ring, wherein when the seat ring is closed to cover the toilet body, the first sealing strip is contacted with the toilet body, wherein when the seat cover is closed to cover the seat ring, the seat cover sealing ring is contacted with the seat ring, wherein the seat ring and the seat cover are respectively mounted on the toilet body through a pivotal shaft, wherein when the toilet cover plate is closed to cover the toilet body, the first sealing strip is contacted with the toilet body, and the seat cover sealing ring is contacted with the seat ring, wherein a support rib is disposed at the bottom portion of the seat cover, and wherein the seat cover sealing ring is connected with the support rib and surrounds an outer surface of the support rib.

15. The toilet according to claim 14, wherein at least one buffer air cavity is formed between the seat cover sealing ring and the support rib, wherein a channel is formed between the seat cover sealing ring and the support rib and configured to allow air to flow into and from the at least one buffer air cavity, and wherein when the seat cover is closed to cover the seat ring, the channel is communicated with the seat ring hole.

16. The toilet according to claim 14, wherein a bottom portion of the first sealing strip is connected with an elastic membrane, wherein the elastic membrane extends towards the seat ring hole, wherein when the seat ring is closed to cover the toilet body the elastic membrane contacts the toilet body, wherein when an inside air pressure of the elastic membrane is greater than or equal to an outside air pressure of the elastic membrane, the elastic membrane keeps in contact with the toilet body, and wherein when the outside air pressure of the elastic membrane is greater than the inside air pressure of the elastic membrane, the elastic membrane is at least partially separated from the toilet body.

17. A method for cleaning a toilet body of a toilet, the method comprising:

providing an elastic membrane connected with a seat ring of the toilet;

closing the seat ring and a seat cover of the toilet to cover the toilet body and allow the elastic membrane to contact the toilet body;

flushing the toilet body with water;

in response to the flushing, increasing an inside air pressure of the elastic membrane, wherein when the inside air pressure of the elastic membrane is greater than or equal to an outside air pressure of the elastic membrane, the elastic membrane is maintained in contact with the toilet body;

in response to a draining of the water in the toilet body, decreasing the inside air pressure of the elastic membrane, wherein when the outside air pressure of the elastic membrane is greater than the inside air pressure of the elastic membrane, the elastic membrane is at least partially separated from the toilet body;

forming at least one buffer air cavity between a support rib disposed at a bottom portion of the seat cover and a seat cover sealing ring surrounding the support rib;

forming a channel between the seat cover sealing ring and the support rib, the channel configured to allow air to flow into and from the at least one buffer air cavity; in response to the closing of the seat ring and the seat cover, communicating the channel with a seat ring hole of the seat ring;

supplying water into the toilet body after the draining of the water in the toilet body; and in response to the supplying of the water, allowing the air in the toilet body to enter the buffer air cavity through the seat ring hole and the channel.

* * * * *